US008037548B2

(12) United States Patent
Alexander et al.

(10) Patent No.: US 8,037,548 B2
(45) **Date of Patent: *Oct. 18, 2011**

(54) ADJUSTABLE HELMET

(75) Inventors: Garnet Alexander, Beaconsfield (CA); Vittorio Bologna, Chicago, IL (US)

(73) Assignee: Sport Maska Inc., Montreal, Quebec (CA)

( * ) Notice: Subject to any disclaimer, the term of this patent is extended or adjusted under 35 U.S.C. 154(b) by 1231 days.

This patent is subject to a terminal disclaimer.

(21) Appl. No.: 11/622,871

(22) Filed: Jan. 12, 2007

(65) Prior Publication Data

US 2007/0266481 A1 Nov. 22, 2007

Related U.S. Application Data

(63) Continuation of application No. PCT/CA2005/001085, filed on Jul. 13, 2005.

(60) Provisional application No. 60/587,541, filed on Jul. 14, 2004.

(51) Int. Cl.
*A42B 1/22* (2006.01)

(52) U.S. Cl. ..... 2/418; 2/417

(58) Field of Classification Search ..... 2/410, 417, 2/418, 421

See application file for complete search history.

(56) References Cited

U.S. PATENT DOCUMENTS

| | | | | |
|---|---|---|---|---|
| 631,880 | A | | 8/1899 | Ross |
| RE17,064 | E | | 8/1928 | Fisher |
| 2,802,212 | A | | 8/1957 | Finken |
| 3,107,356 | A | * | 10/1963 | Pestronk et al. ..... 2/420 |
| 3,329,968 | A | | 7/1967 | Gordon |
| 3,389,405 | A | | 6/1968 | Fattori |
| 3,444,560 | A | * | 5/1969 | Northup, Jr. ..... 2/8.1 |
| 3,787,894 | A | | 1/1974 | Goodman, Jr. |
| 3,878,562 | A | | 4/1975 | Lamb |
| 3,991,423 | A | | 11/1976 | Jones |
| 4,259,747 | A | | 4/1981 | Taesler et al. |
| 4,404,690 | A | | 9/1983 | Farquharson |
| 4,477,929 | A | | 10/1984 | Mattsson |
| 4,890,338 | A | | 1/1990 | Knabenhans |
| 4,942,628 | A | | 7/1990 | Freund |
| RE34,699 | E | | 8/1994 | Copeland et al. |
| 5,373,588 | A | | 12/1994 | Hede et al. |
| 5,511,250 | A | | 4/1996 | Field et al. |

(Continued)

FOREIGN PATENT DOCUMENTS

SU 1301372 A1 8/1985

*Primary Examiner* — Shaun R Hurley
*Assistant Examiner* — Andrew Sutton
(74) *Attorney, Agent, or Firm* — Norton Rose OR LLP

(57) ABSTRACT

A helmet (20) comprising a mechanism (28) to increase or decrease the internal volume thereof through the displacement of one or more portions (32) of the protective material (24) lining the helmet shell (22). The adjustment mechanism (28) is mounted on or adjacent the shell (22) of the helmet (20), from which project one or more connectors (30) which are operationally connected to the movable portions (32) of the protective material (24). When the adjustment mechanism (28) is activated, for example clockwise or counterclockwise, the connectors (30) are displaced, which causes the movable portions (32) of the protective material (24) to either be displaced away from the shell (22) of the helmet (20) or towards the shell (22) of the helmet (20) and thus allowing for a fine tuning of the fit of the helmet (20) on a player's head.

48 Claims, 13 Drawing Sheets

U.S. PATENT DOCUMENTS 5,572,749 A 11/1996 Ogden
5,704,072 A 1/1998 Garneau
5,708,988 A 1/1998 McGuine et al.
5,765,234 A 6/1998 Petzl et al.
5,815,847 A 10/1998 Holden, Jr.
5,893,174 A 4/1999 Primeau
5,950,245 A 9/1999 Binduga
6,032,297 A 3/2000 Barthold et al.
6,081,931 A 7/2000 Burns et al.
6,108,824 A 8/2000 Fournier
6,154,889 A * 12/2000 Moore et al. ..... 2/418
6,226,802 B1 5/2001 Sasaki et al.
6,256,798 B1 7/2001 Egolf et al.
6,324,700 B1 12/2001 McDougall
6,332,227 B1 12/2001 Fang
6,385,780 B1 5/2002 Racine
6,425,142 B2 7/2002 Sasaki et al.
6,609,254 B2 * 8/2003 Bielefeld et al. ..... 2/416
6,647,556 B2 * 11/2003 Grepper et al. ..... 2/425
6,708,376 B1 3/2004 Landry
6,760,927 B2 7/2004 Guay
6,865,752 B2 3/2005 Udelhofen et al.
6,966,075 B2 11/2005 Racine
6,968,575 B2 11/2005 Durocher
6,981,284 B2 1/2006 Durocher
7,000,262 B2 2/2006 Bielefeld
7,043,772 B2 5/2006 Bielefeld et al.
7,174,575 B1 * 2/2007 Scherer ..... 2/418
2004/0117897 A1 6/2004 Udelhofen et al.
2005/0034222 A1 2/2005 Durocher
2005/0034223 A1 2/2005 Durocher
2005/0262619 A1 12/2005 Musal et al.
2006/0080761 A1 4/2006 Huh

* cited by examiner

ADJUSTABLE HELMET

CROSS-REFERENCE TO RELATED APPLICATIONS

This is a continuation of International Application No. PCT/CA2005/001085 filed Jul. 13, 2005, designating the United States, which itself claims priority on U.S. provisional application 60/587,541 which was filed Jul. 14, 2004, the specifications of both of which are incorporated herein by reference.

FIELD OF THE INVENTION

The present invention relates to helmets, and is particularly concerned with adjustable helmets.

BACKGROUND OF THE INVENTION

Helmets for various activities, including sporting activities and work in dangerous environments, often require a shell or protective surface. The range of shapes and sizes of a wearer's head may require a helmet to be made larger or smaller to fit. Furthermore, adjustment may be required depending on the activity, environmental conditions, appearance, or some other factor. In particular, the wearer of a helmet may want to have a tighter or looser fit, depending on circumstances, or may alternatively want to modify the fit, for example during play, or depending on the season, etc.

Adjustable helmets typically include two sections that are moved to lengthen the helmet. For example, U.S. Pat. No. 4,477,929 to Mattsson discloses an adjustable helmet wherein adjustment typically requires the use of a screwdriver to tighten and loosen a screw. Loosening of the screw permits the helmet to be adjusted, and tightening of the screw maintains the helmet in a particular configuration. This requirement for additional tools to adjust the helmet may make it difficult to adjust the helmet when proper tools are not available. Other helmets known in the art also have limitations making them difficult or otherwise inconvenient to use.

Accordingly, there is a need for alternative helmets.

SUMMARY OF THE INVENTION

In accordance with a broad aspect of the present invention, there is provided for a helmet comprising an internal adjustment mechanism wherein the internal padding of a helmet may be adjusted so as to provide a more snug or tight fit to the user's head. It is known in the art through the use of various methods or mechanisms, to adjust the overall size of a helmet for example through the lengthening or shortening of the exterior or outer shell thereof. However, even when a user has adjusted the outer or overall length of a helmet, the same user may further require or wish for a finer adjustment of the internal fit of the helmet. Thus, the present invention may be combined with another invention, for example the use of new or know inventions for the lengthening or shortening of the outer shell of a helmet in combination with a finer adjustment of the internal padding thereof. Alternatively, the present invention may be used with a standard helmet, i.e. a helmet which is not provided with an adjustment mechanism for the modification of the outer shell thereof. In this configuration, the present invention may provide for smaller adjustments of the interior size or volume of the helmet.

In accordance with a broad aspect of the invention there is provided for a helmet comprising:

an external protective shell, protective material mounted internally on said shell with at least a portion of said material being movable relative to said shell;

an adjustment mechanism mounted adjacent said shell; and a connector operationally connected to said movable portion of protective material and to said adjustment mechanism, said connector being displaceable by said adjustment mechanism such that said connector entrains said movable portion of protective material so as to vary the volume defined by said helmet. Alternatively, the invention may also provide for a second movable portion of protective material, and a second connector operationally connected to said second movable portion of protective material and to said adjustment mechanism.

In a further embodiment of the invention there is provided for a helmet wherein said movable portion or portions of protective material are located laterally within said shell, said adjustment mechanism is located at a longitudinal end of said shell, said movable portions of protective material being displaceable closer to each other when said adjustment mechanism displaces said connectors.

Conveniently, the present invention may provide for a helmet wherein the adjustment mechanism includes a sprocket rotatably mounted thereto, said connector includes at least two teeth for engaging said sprocket, and wherein said connector is displaced when said sprocket is rotated. The helmet may further comprise teeth which are aligned along a length of an opening defined by said connector, said opening being dimensioned to permit placement and rotation of said sprocket therein, and wherein said sprocket moves relative to said connector within said opening when said sprocket is rotated.

Further, the present invention may provide for a helmet wherein the adjustment mechanism includes a ratchet to facilitate rotation of said sprocket in one direction and to inhibit rotation of said sprocket in the other direction. The ratchet may permit rotation of the sprocket to displace said connector.

Further, the present invention may provide in an alternative embodiment, a helmet comprising:

a shell including a first shell section and a second shell section, said sections being movable relative to one another, an adjustment mechanism mounted to said first shell section;

a connector mounted between said second shell section and said adjustment mechanism; and wherein the entire connector moves in the general direction of said adjustment mechanism when pulled by said adjustment mechanism, to encourage said second shell section to move and vary the shape of the volume defined by said helmet.

The helmet of the present invention may also be provided with a ratchet which includes a pawl and at least two corresponding notches defined along a generally circular feature which is axially aligned with said sprocket, and wherein said notches include an inclined face for permitting movement of said pawl out of said notch when said sprocket is rotated in said one direction.

Other and further advantages and features of the invention will be apparent to those skilled in the art from the following detailed description of embodiments thereof, taken in conjunction with the accompanying drawings.

BRIEF DESCRIPTION OF THE FIGURES

The invention will be further understood from the following detailed description of embodiments of the invention, with reference to the drawings in which.

DETAILED DESCRIPTION OF THE INVENTION

Figure 1:
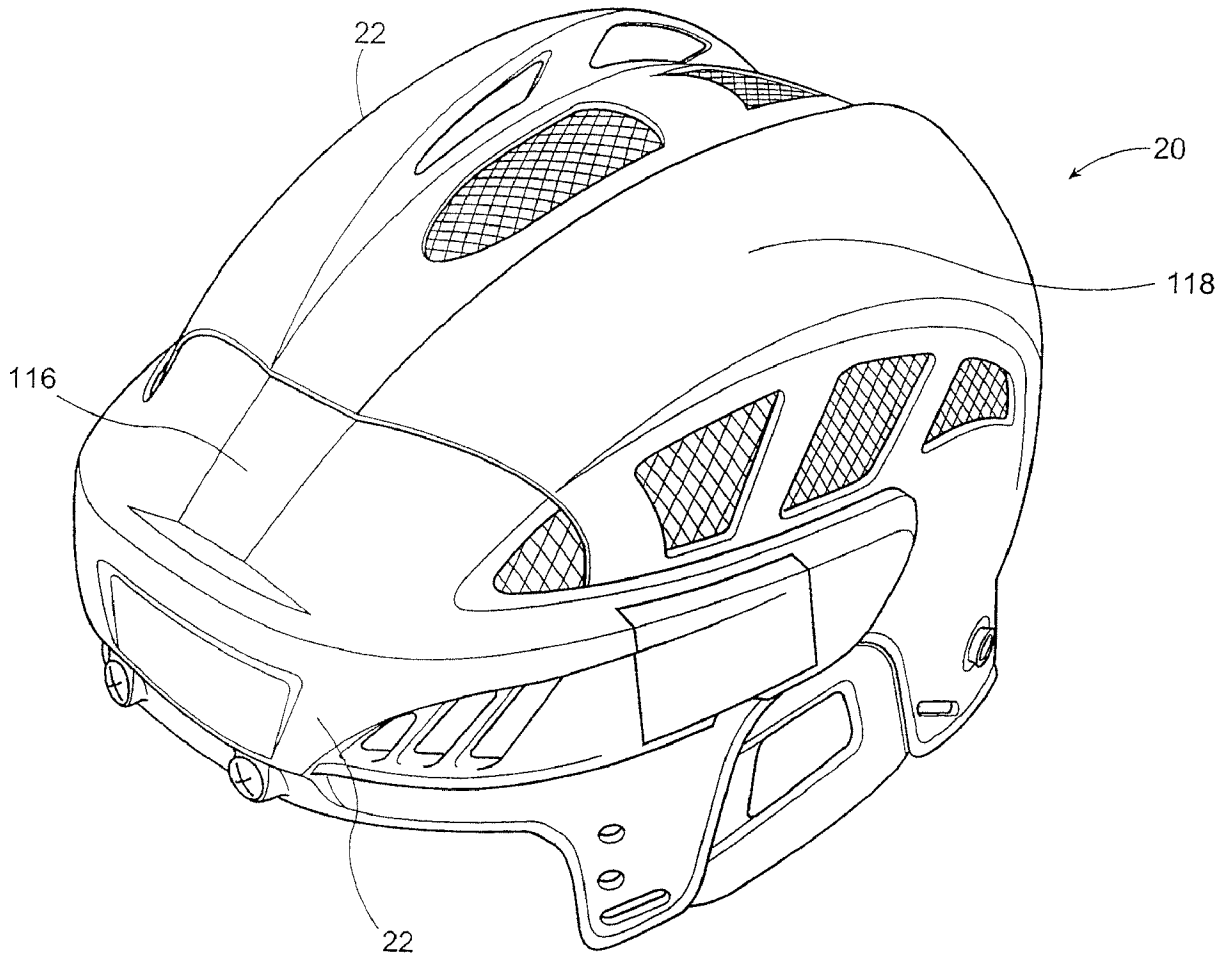
FIG. 1 illustrates in isometric view, an adjustable helmet in accordance with an embodiment of the invention.

Similar references are used in different figures to denote similar components. FIG. 1 shows an adjustable helmet in accordance with an embodiment of the invention.

Helmet 20 includes a shell 22, and may include additional protective material such as padding 24. Padding 24 may include foam, fabric, a polymer or any other material that may serve to absorb and/or limit the effects of a force applied to helmet 20 on a wearer. The padding 24 may also have as a function to provide comfort for the user thereof. The protective material may be a resilient material, and in an embodiment padding 24 is made of a styrofoam-type material. Additional padding may be added for increased protection and/or comfort in the form of foam inserts 26, or some other appropriate material (see FIG. 2).

Figure 2:
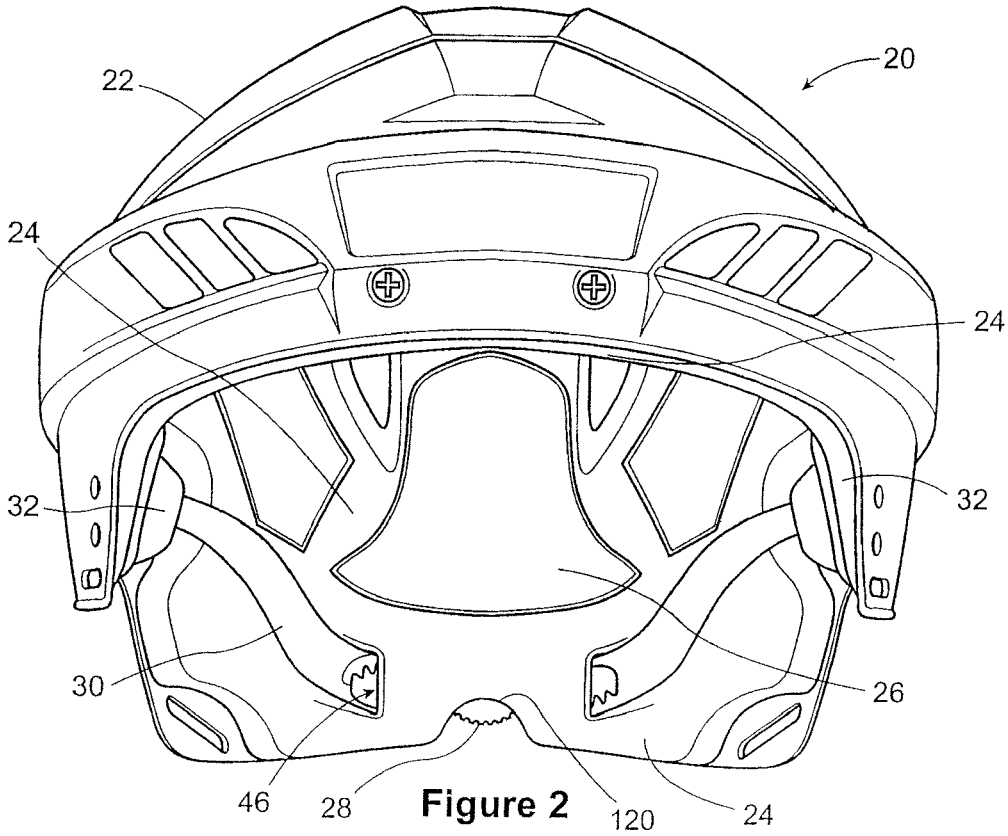
FIG. 2 illustrates in interior rear view of the helmet of FIG. 1.
Figure 3:
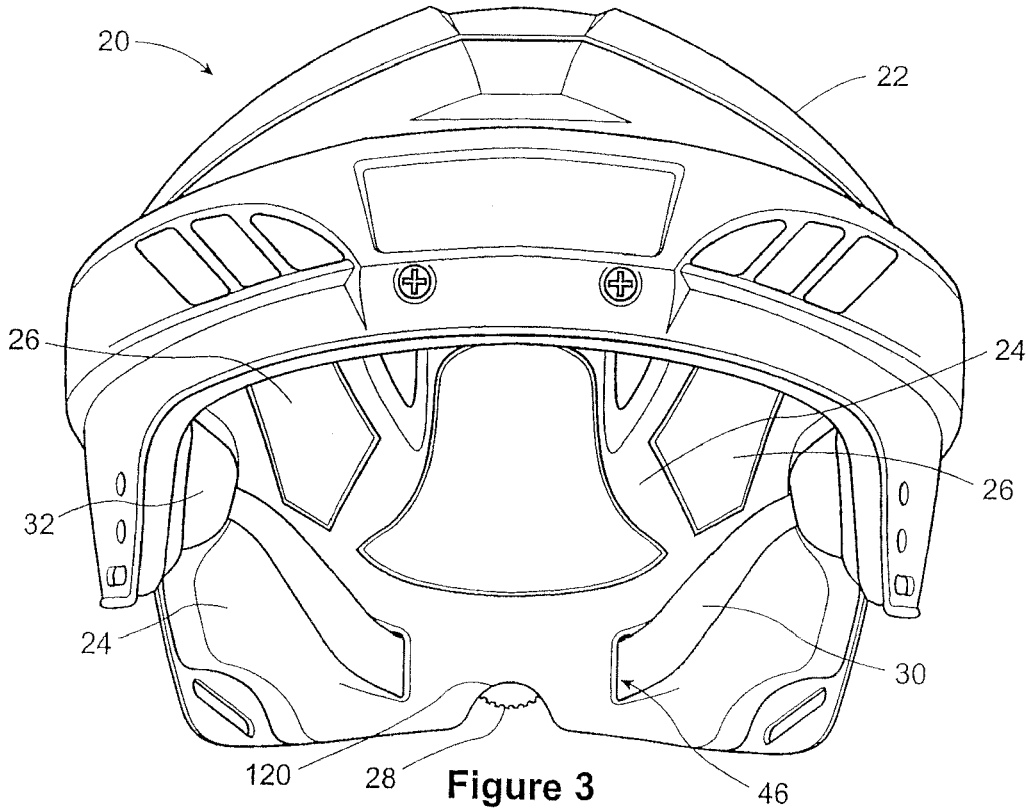
FIG. 3 illustrates the helmet of FIG. 2 with the connectors in a somewhat retracted position.

As shown in FIGS. 2 and 3, helmet 20 includes an adjustment mechanism 28. Adjustment mechanism 28 may be connected to a portion of padding 24, which padding 24 may be disposed distally form adjustment mechanism 28. At least one, and possibly more than one, connector 30 may be used to connect adjustment mechanism 28 to padding 24 (one or more portions of padding. Activation of adjustment mechanism 28 permits connector 30 to be drawn generally towards adjustment mechanism 28 to encourage movement of at least a portion of connected padding 24. Alternatively, activation of adjustment mechanism 28 permits connector 30 to be drawn generally away from adjustment mechanism 28 to encourage movement of at least a portion of connected padding 24 away form adjustment mechanism 28. Adjustment mechanism 28 may thus be used to decrease the internal volume of helmet 20, i.e. to create a tighter fit, or alternatively, to increase the internal volume of helmet 20, i.e. to create a looser fit.

FIG. 3 illustrates the displacement of a moveable portion 32 caused by pulling of connector 30 by adjustment mechanism 28. This displacement of movable portion 32 may cause a change in the shape of an internal volume defined by helmet 20, i.e. for example reducing the volume. Such change may advantageously enable helmet 20 to be adjusted to different head sizes and head shapes of a wearer. Additionally, or alternatively, such change may serve to increase the comfort and/or safety of the helmet for the wearer.

In some embodiments, moveable padding portion 32 may be the only padding that is used for helmet 20, without any other padding being used. In the illustrated embodiment, padding 24 substantially covers an internal surface of helmet 20. Moveable padding portion 32 may form part of and be integrally formed with the rest of padding 24, or it may be a separate piece on its own.

While padding 24 is mounted (whether by friction, glue, screws, or in some other manner) to helmet shell 22, moveable padding portion 32 is preferably not attached to shell 22. This permits a measure of movement in moveable padding portion 32 when a force is applied to it by connector 30. In the illustrated embodiment, two moveable padding portions 32 are included and are located at or about the temple area of helmet 20. Moveable padding portion 32 may alternatively be located in some other location, for example at an apex 34 of an interior of helmet 20 (see FIG. 15A). Further, it may be understood that moveable padding portion 32 may be in part connected to helmet shell 22. Thus, moveable padding portion 32 may comprise two portion, a first portion, i.e. a minor portion, which is connected, through gluing, screws, or other means to the helmet 22, and a second portion, i.e. a major portion which is free to be displaced by connector 30. In a further embodiment, moveable padding portion 32 may simply be a part of padding 24 which has been cut out, for example in the form of a tab or finger, and which may be the only portion of padding 24 which is not connected (by gluing, screws, etc. . . . ) to the helmet shell 22.

The material used for padding 24 should be somewhat bendable to permit movement at least in padding portion 32, which is preferably not attached to shell 22. Alternatively, padding portion 32 may be attached to helmet shell 22 provided that underlying portion of helmet shell 22 itself is permitted to deform sufficiently to change the shape of the interior volume of helmet 20. In a further embodiment, moveable padding portion 32 may be a moveable layer of padding disposed over a fixed layer attached to helmet shell 22.

Padding 24 may also be made of a resilient material. This may permit padding 24, and in particular, padding portion 32, to return to an initial position adjacent shell 22 when a force is no longer applied by connector 30 in the general direction of adjustment mechanism 28. Using a resilient material may thereby encourage a loosening of helmet 20, when worn, when connector 30 is not retained by adjustment mechanism 28. Alternatively, padding portion 32 may be connected to shell 22 and/or the remainder of padding 24 by a resilient material or padding to produce similar results. In an alternative embodiment, the resiliency of padding portion 32 may be away from shell 22. In this way the resilient material may encourage a tightening of helmet 20, when worn, when connector 30 is not retained by adjustment mechanism 28.

Padding portion 32 may be detachably attached to shell 22, for example, by Velcro® or a releasable glue, or in some another manner to permit it to move when connector 30 is moved. In other embodiments, movement of padding portion 32 may be facilitated by a hinge or other bendable area between padding portion 32 and shell 22 or the remainder of padding 24, if additional padding is employed.

As connector 30 is used to move padding portion 32, other parts of helmet 20, such as portions of padding 24 adjacent, or connected to, padding portion 32 may also be encouraged to move. Similarly, portions of shell 22 may also be encouraged to move if shell 22 is made of a flexible material. In the illustrated embodiment (see, for example, FIG. 15A) padding 24 includes two sections, a front section 24*a* and a rear section 24*b*. Moveable padding portion 32 forms part of front padding section 24*a*. Accordingly, connector 30 may cause some or all of front padding section 24*a* to move when it is pulled or pushed by adjustment mechanism 28.

In an alternative embodiment (not shown), padding portion 32 may be fixed to shell 22 and adjustment mechanism 28 may be mounted to rear padding section 24*b*. In this embodiment padding to which adjustment mechanism 28 is mounted or abutting is encouraged to move. For example, rear padding section 24*b* may be unattached to shell 22 (or attached at one or more locations, not including areas of rear padding section 24*b* adjacent adjustment mechanism 28). Pulling of connector 30 by adjustment mechanism 28 may encourage movement of rear padding section 24*b* (at least in portions unattached to helmet shell 22) generally toward padding portion 32, or at least inwardly of shell 22, to vary the shape of the volume defined by padding 24 and/or shell 22. This example illustrates that the padding located adjacent one or both ends of connector 30 may be configured to be movable by activation of adjustment mechanism 28.

In the illustrated embodiment, padding portion 32 (and, in some cases, other portions of padding 24) may be encouraged to a position adjacent shell 22 when a force is applied to it via connector 30. This movement in padding 32 (and 24) may also serve to change the shape of the volume enclosed by helmet 20, and may permit helmet 20 to be worn by a wearer with a larger head, or more comfortably. Padding portion 32 may have an initial position wherein it is displaced from shell 22. Adjustment mechanism 28 may then be used to apply a force to push connector 30, and by connection padding portion 32, to encourage movement of padding portion 32 to a position closer to shell 22. As may be understood, connector 30 may thus be sufficiently resilient to transfer force in both tension and compression. In the illustrated embodiment, padding portion 32 is initially located adjacent shell 22 and is pulled by connector 30 away from shell 22.

Figure 4:
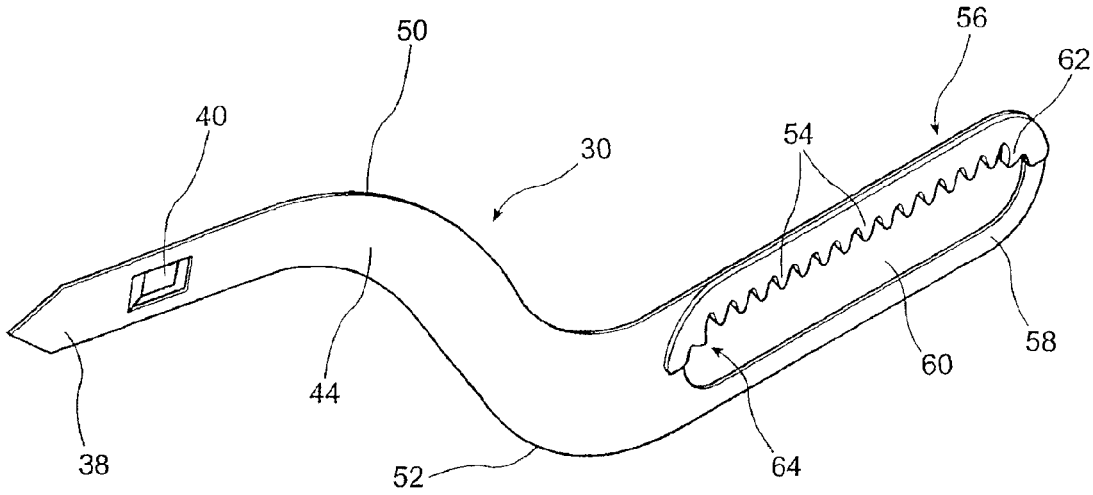
FIG. 4 illustrates an isolated isometric view of a connector of the helmet of FIG. 1.
Figure 5:
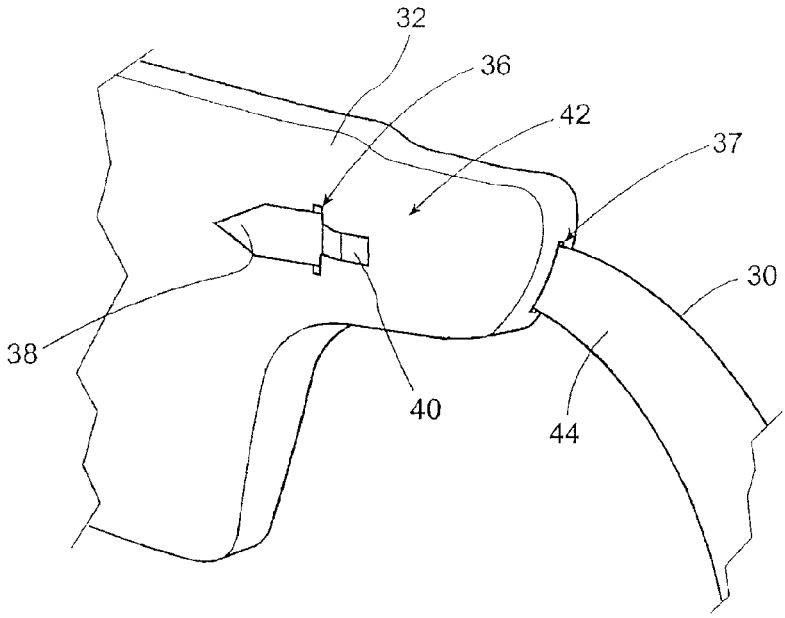
FIG. 5 illustrates an isolated isometric view of the connector end inserted into a portion of the protective material of the helmet of FIG. 1.

Referring to FIGS. 4 and 5, connector 30 may be mounted to portions of padding 24 at or adjacent padding portion 32 to permit a force to be transferred to padding portion 32 by connector 30 to I cause movement in padding portion 32. Connector 30 may be joined to padding portion 32 (or 24) by glue, Velcro®, the use a pin or other type of suitable fastener. In addition, the connector 30 and padding 32 may: be made integral. In the embodiment illustrated, connector 30 is a strap that is received by an opening 36 defined in padding portion 32. Opening 36 defines a passage 37 through padding 32. An end 38 may be inserted into opening 36 to be retained therein. End 38 may be further extended right through passage 37 for retention within opening 36. The illustrated embodiment of the strap of connector 30 is a rigid, plastic strap of suitable size and stiffness to translate force in both compression and tension.

Connector end 38 may include a feature to inhibit removal thereof once inserted through opening 36. Such feature may include a pin, button, rivet, prong, tab, finger or some other suitable arrangement. In the illustrated embodiment, connector end 38 includes a resilient prong 40. Resilient prong may be added to, stamped from, or integrally formed in connector 30. Prong 40 may project from connector end 38 generally away from the direction of insertion of end 38 into opening 36.

Connector end 38 may be assembled to padding portion 32 by inserting connector end 38 into opening 36. As connector end 38 is inserted, opening 36 is dimensioned to permit a profile of connector end 38 to pass therethrough. As connector end 38 traverses passage 37 resilient prong 40 is encouraged by walls of passage 37 to lie against (or within, if space permits) connector 30 to permit passage of connector end 38 and resilient prong 40 therethrough. Once connector end 38 extends through passage 37, resilient prong 40 returns to its initial position proud of connector end 38. Removal of connector end 38 may be inhibited by resilient prong 40 which catches a surface 42 of padding portion 32 when it is pulled in a direction generally opposite to the direction of insertion into passage 37. This arrangement may permit connector 30 to move at least padding portion 32, for example the portion closest to adjusting mechanism 28, when it is pulled by adjustment mechanism 28.

Further insertion of connector 30 into opening 36 may be inhibited by a widened area 44 of connector 30 which has a larger profile than connector end 38. Widened area 44 may either be thicker or broader or larger in any other dimension to inhibit further insertion of connector end 38 into passage 37. Alternatively, connector 30 may have a pin, rivet or other protrusion or feature to inhibit further insertion. This arrangement permits connector 30 to move at least padding portion 32 when connector 30 is pushed by adjustment mechanism 28. In some embodiments, connector end 38 may merely move further into passage 37 when it is pushed.

In the present description connector 30 is described as pushed and pulled by adjustment mechanism 28. This terminology is a shorthand to indicate movement of connector 30 relative to adjustment mechanism 28. For example, when connector 30 is moved generally away from adjustment mechanism 28, it is said to be pushed by adjustment mechanism 28.

As best seen in FIG. 4, connector 30 may be formed as a generally flat band. Connector 30 may be made of a somewhat rigid material, such as a plastic, a metal, or some other material that does not significantly deform when a force is applied along its length. Connector 30 may also be integrally formed in padding 24, for example, as an extension of movable padding portion 32.

Connector 30 may be a generally linear piece of plastic that permits lateral deformation thereof so that it conforms somewhat with an inner surface of shell 22 and/or padding 24.

Likewise, the dimensions of connector 30 are selected in the illustrated embodiment in an attempt to reduce the extent to which it projects into the interior of helmet 20. This limited projection is meant to make the helmet more comfortable when worn. In an attempt to accomplish this, adjustment mechanism 28 may be located adjacent an exterior surface of helmet shell 22, or it may be sandwiched between shell 22 and padding 24. Passageways 46 in padding 24 may be configured to permit connector 30 to interface with adjustment mechanism 28 when adjustment mechanism 28 is located on another side of padding 24.

Connector 30 may additionally include at least one curve 50 to permit connector 30 to conform to an interior surface of padding 24 so that it is less likely to interfere with a wearer's comfort. One or more additional curves, such as second curve 52, may also be included for this purpose. The shape, i.e. curve of connector 30 may also help or promote the displacement of padding portion 32, i.e. away form helmet shell 22.

While connector 30 has been described as having a low profile and as being made of a laterally flexible material, it may also be made of a more rigid material and/or a more pronounced profile so that it does vary the shape of the volume defined by helmet 20. This may permit connector 30 to itself affect the fit of helmet 20 as connector 30 is moved by adjustment mechanism 28 (these embodiments are not shown). For example, connector 30 may have an area of increased thickness at or about curve 50. As connector 30 is moved, this area of increased thickness also moves, which may affect the fit of the helmet 20 on a wearer's head.

Connector 30 may alternatively be made of a material that deforms when it is pushed or deforms when it is pulled. For example, connector 30 may be made of a material that may not be effectively pushed, such as cable, rope, belt, chain, cord or string. When configured in this manner, connector 30 may be used to pull padding portion 32, but pushing of connector 30 (and attached padding portion 32) may be limited. This arrangement may also include a padding portion 32 that is resiliently biased towards helmet shell 22. When, for example, string is used for connector 30, it may be used to pull resilient padding 32. When the string connector is released by adjustment mechanism 28, the resilient padding may return to its initial position. Similarly, connector 30 may be made of a material such as rubber that may be used to push padding portion 32 into position adjacent shell 22, but that may be less effective at pulling padding portion 32. This arrangement may cooperate with a padding portion 32 that is resiliently biased away from shell 22. A rubber-like connector 30 may also provide support to a wearer's head when helmet 20 is worn. In this embodiment, wherein the connector 30 may only push, there may be provided with a second adjustment mechanism (not shown) which would act in the opposite direction of the first adjustment mechanism 28.

In an alternative embodiment, connector 30 may run between shell 22 and padding 24 (not shown) to reduce any interference between connector 30 and a wearer's head. In the further alternative, connector 30 may pass along an outer surface of shell 22 (not shown) or a combination of interior and exterior. If adjustment mechanism 28 is located inside of shell 22, then slots may be required to permit passage of connector 30 between adjustment mechanism 28 and the outside of shell 22. Additional slots may also be required for connector end 38 to engage padding portion 32, when connector 30 is configured in this manner.

Adjustment mechanism 28 may be placed within padding 24, and may even stand proud of padding 24 within the volume defined by padding 24. Such arrangement may encourage retention of helmet 20 on a wearer's head, and may engaged a wearer's head adjacent the nape thereof.

Connector 30 engages adjustment mechanism 28, permitting it to be moved by adjustment mechanism 28. For example, connector 30 may be frictionally engaged by adjustment mechanism 28, or a pivoting lever of adjustment mechanism 28 which releasably engages connector 30. Alternatively, if the material used for connector 30 permits, connector 30 may be wrapped and unwrapped around components of adjustment mechanism 28 to permit it to be moved. In the illustrated embodiment, connector 30 engages adjustment mechanism 28 (see FIG. 9A, for example). Slots, protrusions, or some other feature of connector 30 may be employed to engage adjustment mechanism 28.

As shown in FIG. 4, connector 30 includes at least one tooth 54 (also referred to as teeth 54 if more than one tooth is employed). Connector 30 may include sixteen teeth, as illustrated, or may include more, depending on the range of motion required. One or more of teeth 54 may engage a corresponding feature of adjustment mechanism 28. Teeth 54 may be longitudinally aligned along an edge of connector 30. Teeth 54 may be located along an edge 56 of connector 30 disposed opposite to end 38 of connector 30. Teeth 56 may be formed as protrusions extending laterally inward of connector 30; alternatively, teeth 56 may be formed as protrusions extending from a surface of connector 30, including protruding laterally outward of connector 30. In the illustrated embodiment, teeth 56 are integrally formed in connector 30 and extend within a similar plane (or alternatively, the same plane) as connector end 56. Teeth 56 but may alternatively be mounted or otherwise added to connector 30.

A guide may be included at connector end 56 to facilitate engagement of connector end 56 with adjustment mechanism 28. Guide 58 may additionally or alternatively impart a degree of stiffness or rigidity in connector end 56. Such rigidity may serve to encourage alignment of teeth 54 for engagement with adjustment mechanism 28. Guide 58 may also resist deformation of connector 30 as it is pulled and pushed by adjustment mechanism 28.

At or about connector end 56, connector 30 may be provided with additional material to increase its rigidity. In the illustrated embodiment, the thickness of end 56 at teeth 54 is about double the thickness of the remainder of connector 30. The remainder of connector 30 may similarly be thickened or reinforced. In an embodiment, guide 58 is made thinner than teeth 54 to permit passage of teeth of a second connector adjacent thereto (see, for example, FIG. 9B).

Connector 30 may include a slot 60 defined therein. Slot 60 may be defined by teeth 54 and guide 58. Slot 60 may permit passage of one or more parts of adjustment mechanism 28 to pass therethrough as connector 30 is moved. To the extent that an element of adjustment mechanism 28 is located within connector slot 60, a closed end 62 of connector 30 may serve to inhibit removal of connector 30 from adjustment mechanism 28. Similarly, a longitudinally inward end 64 of slot 60 may inhibit further pulling of connector 30 by adjustment mechanism 28.

Figure 6:
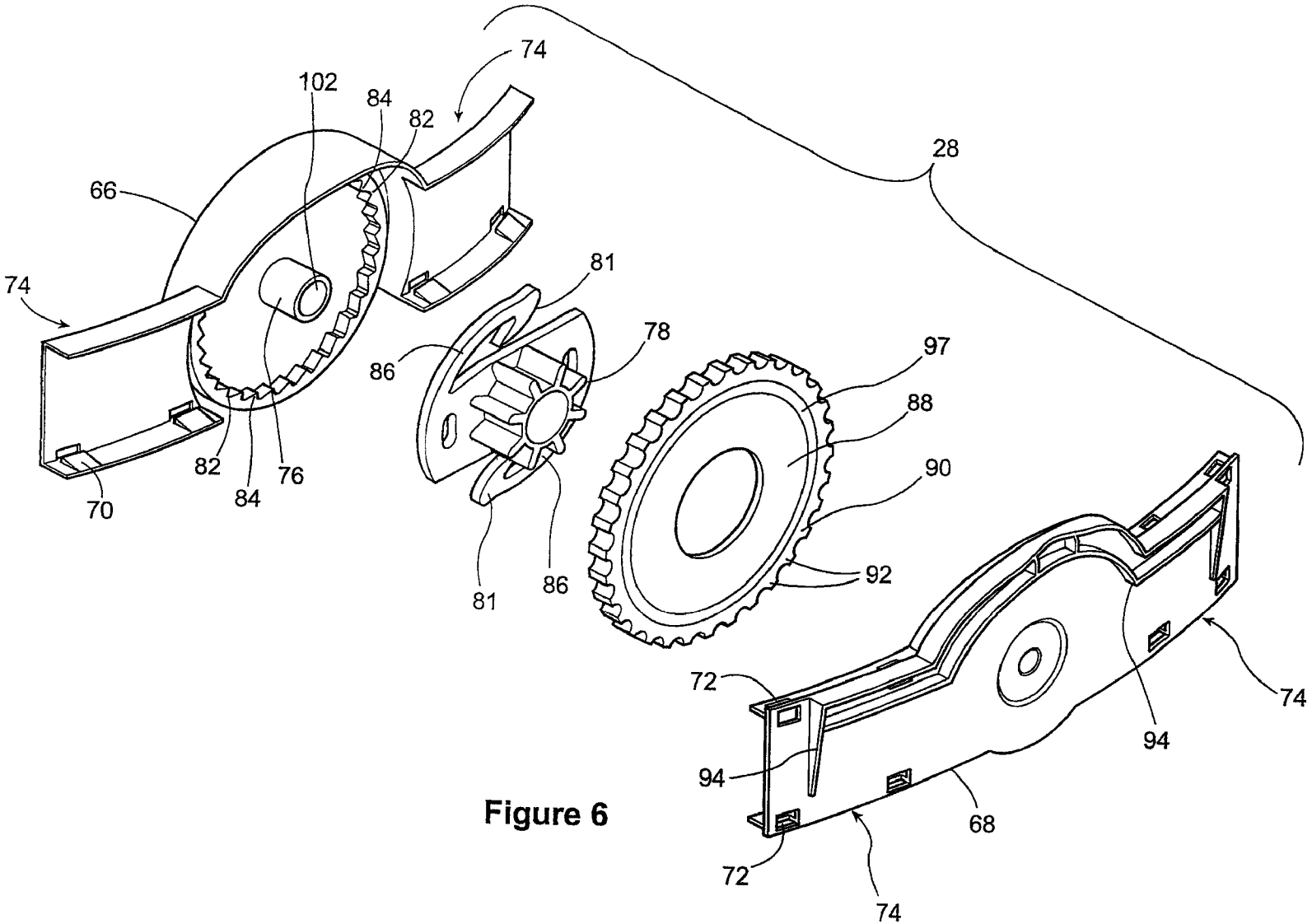
FIG. 6 illustrates an exploded isometric view of components of the adjustment mechanism of the helmet of FIG. 1.

FIG. 6 illustrates an exploded isolated isometric view of the components of an embodiment of adjustment mechanism 28. This embodiment of adjustment mechanism 28 may be sandwiched between shell 22 and padding 24. Accordingly, adjustment mechanism 28 may be curved to reduce its profile therein. Alternatively, adjustment mechanism 28 may be disposed outside of shell 22, or disposed anywhere else on helmet 20 wherein it may have ease of access.

Adjustment mechanism 28 may include at least one and possibly two body members 66 and 68. Body members 66 and 68 may be mounted to one another to enclose the remaining components of adjustment mechanism 28. Body members 66 and 68 may be releasably assembled by a snap fit, or through the use of other attachment means. The snap fit may include one or more cooperating protrusions 70 located on one or both of body members 66 and 68. Protrusion 70 may be received by a corresponding catch 72. Protrusion 70 may be tapered to encourage one or both of catch 72 and protrusion 70 to resiliently deform when brought into contact with one another so that body members 66 and 68 may be releasably engaged to one another. The connection between body members 66 and 68 may alternatively be permanent by melting, gluing, screwing, or otherwise fastening the two parts together. If members 66 and 68 are held together by other parts of helmet 20 (for example, if they are sandwiched between shell 22 and padding 24) then little or no fastening of these members may be required.

Adjustment mechanism 28 may include a guide 74 formed in corresponding portions of body members 66 and 68. Guide 74 may also be mounted or otherwise added to one or both of body members 66 and 68. Guide 74 encourages the proper orientation of connector 30 so that it engages components of adjustment mechanism 28. If more than one connector 30 is employed, then additional guides 74 may be added to adjustment mechanism 28. In the illustrated embodiment two guides 74 are shown.

As shown in FIG. 6, body member 66 may include a post 76 for receiving a sprocket 78. Sprocket 78 may be rotatably mounted to post 76. Teeth 54 of connector 30 engage sprocket 78. When sprocket 78 is rotated, connector 30 is moved accordingly.

Figure 7:
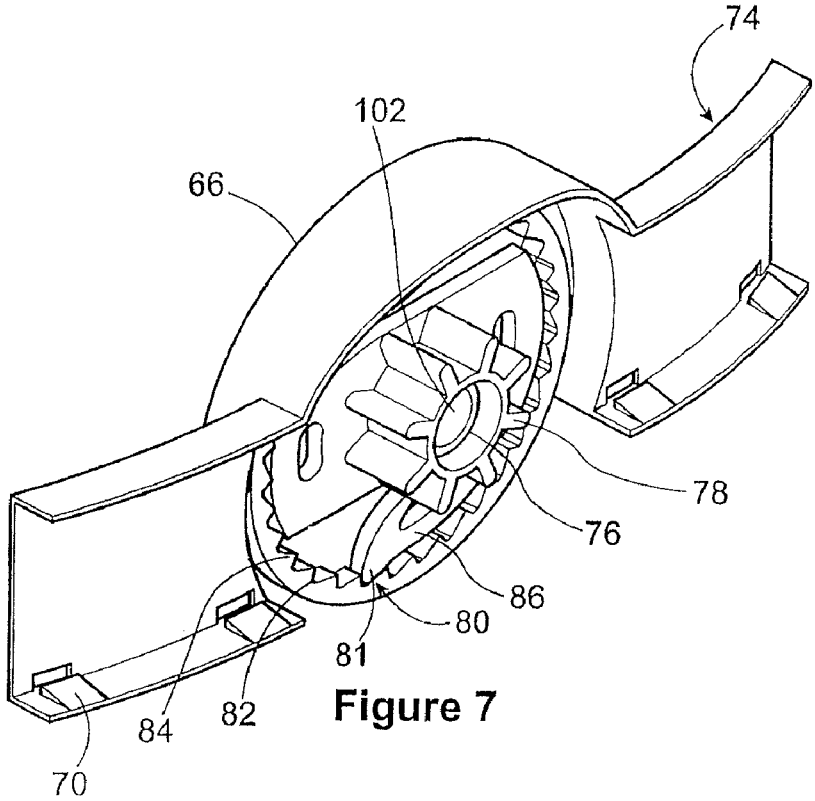
FIG. 7 illustrates an isolated view of an assembled sprocket to a body of the adjustment mechanism of the helmet of FIG. 1.

As illustrated in FIG. 7, sprocket 78 may be configured to rotate freely about post 76. However, to maintain connector 30 in a desired position, motion of sprocket 78 relative to post 66 may be inhibited. For example, sprocket 78 may frictionally engage one or both of post 76 and body member 66. In the illustrated embodiment, sprocket 78 includes a ratchet 80. Ratchet 80 permits rotation of sprocket 78 in one direction, and inhibits rotation in the other direction. In the present embodiment, ratchet 80 permits sprocket 78 to be turned to pull connector 30, and inhibits rotation of sprocket 78 to release or push connector 30. This arrangement permits connector 30 to be pulled, thereby drawing padding portion 32, which may change the internal surface defined by padding 24 to accommodate a smaller head (or to tighten the fit of helmet 20 upon a wearer's head). While further drawing in or pulling of connector 30 by adjustment mechanism 28 may be permitted by ratchet 80, additional release or moving away of connector 30 from adjustment mechanism 28, is inhibited. Hence, ratchet 80 permits further tightening of helmet 20, but discourages loosening of helmet 20. This may be advantageous, for example, in game play, when a tight fit of helmet 20 is desirable, and a loosening or loss of helmet 20 is undesirable. As may be understood, the use of resilient material, such as plastic and the configuration of the ratchet and pawls 81 do not completely preclude release of the connector 30, it is simply discouraged. Pushing in the opposite direction with sufficient strength will cause a loosening of the mechanism 28.

Ratchet 80 may include a pawl 81 which cooperates with at least one, and possibly two or more, notches 82 which are radially displaced from sprocket 78. Notches 82 may be defined by ramped bumps 84, which are angularly displaced and generally located at a similar radial distance from sprocket 78. Angular displacement of bumps 84 may be generally uniform or varied. Bumps 84 may permit rotation of sprocket 78 by a set angular displacement, for example by a number of degrees, in one direction by permitting movement of pawl 81 over the ramped portion of a given bump 84. Conversely, a non-ramped side of bump 84 may serve to discourage movement of pawl 81 over such bump 84 when sprocket 78 is rotated in an opposite direction.

Pawl 81 is preferably resiliently biased relative to sprocket 78. Pawl 81 is thus permitted to resiliently move radially inwardly when sprocket 78 is turned and pawl 81 moves over one of bumps 84. Pawl 81 may include at least one generally arcuate arm 86 connecting it to sprocket 78. In the illustrated embodiment two arcuate arms 86 having two pawls 81 may be connected to sprocket 78 to arch away from sprocket 78 generally in the direction of permitted rotation. Additional arms 86 may be added (not shown). Pawl 81 may alternatively resiliently move over ramped bumps 84 by some other mounting to sprocket 78 such as a spring or foam.

Arms 86 may be biased at generally opposite sides of sprocket 78, and they may arc generally along or adjacent to an imaginary circle traced by pawl 81 when sprocket 78 is rotated. Arms 86 may be integrally formed with sprocket 78. For example, sprocket 78 may be formed of a plastic or other suitable material, and may be made by a process such as injection moulding or extrusion in which arms 86 (and pawls 81) are also formed therein. Alternatively, the foregoing elements may be manufactured and assembled separately.

Figure 8:
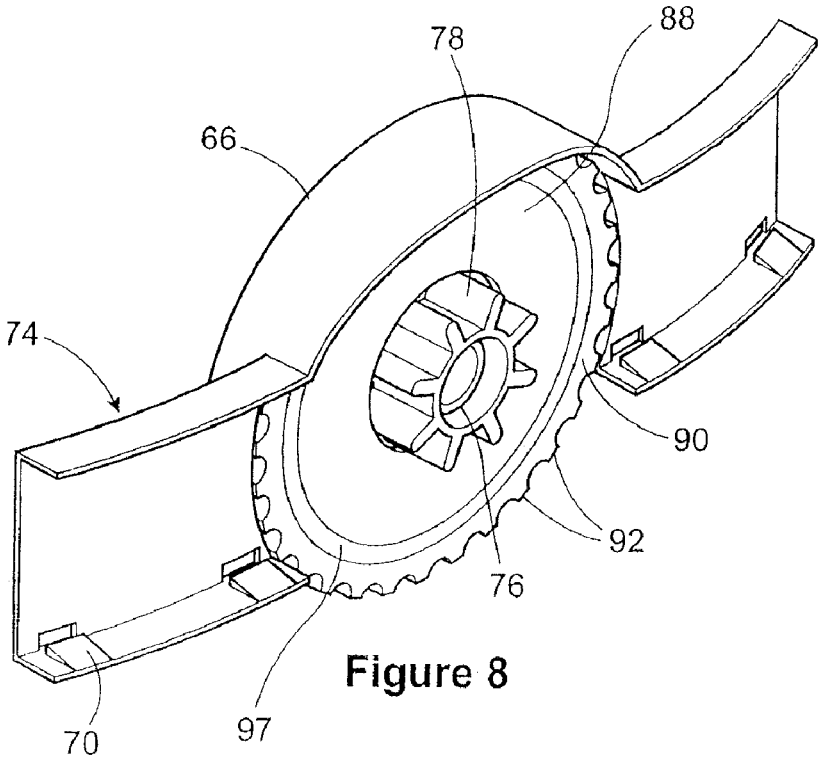
FIG. 8 illustrates the components of the adjustment mechanism illustrated in FIG. 7 additionally including a wheel.

FIG. 8 illustrates a feature that may be included for facilitating rotation of sprocket 78. Such feature may include a wheel 88, or some other feature such as a lever (not shown), that may be used to encourage rotation of sprocket 78 to permit adjustment of helmet 20. Wheel 88 may be mounted to sprocket 78 and may extend, at least partially, beyond body members 66 and 68 to permit access thereto by a hand, finger, thumb or other means for selectively rotating sprocket 78. Wheel 88 may include a grip 90 to inhibit slippage when it is rotated by hand, or in some other manner. Grip 90 may include one or more ridges 92, or some other feature to facilitate rotation of wheel 88.

Figures 9A, 9B:
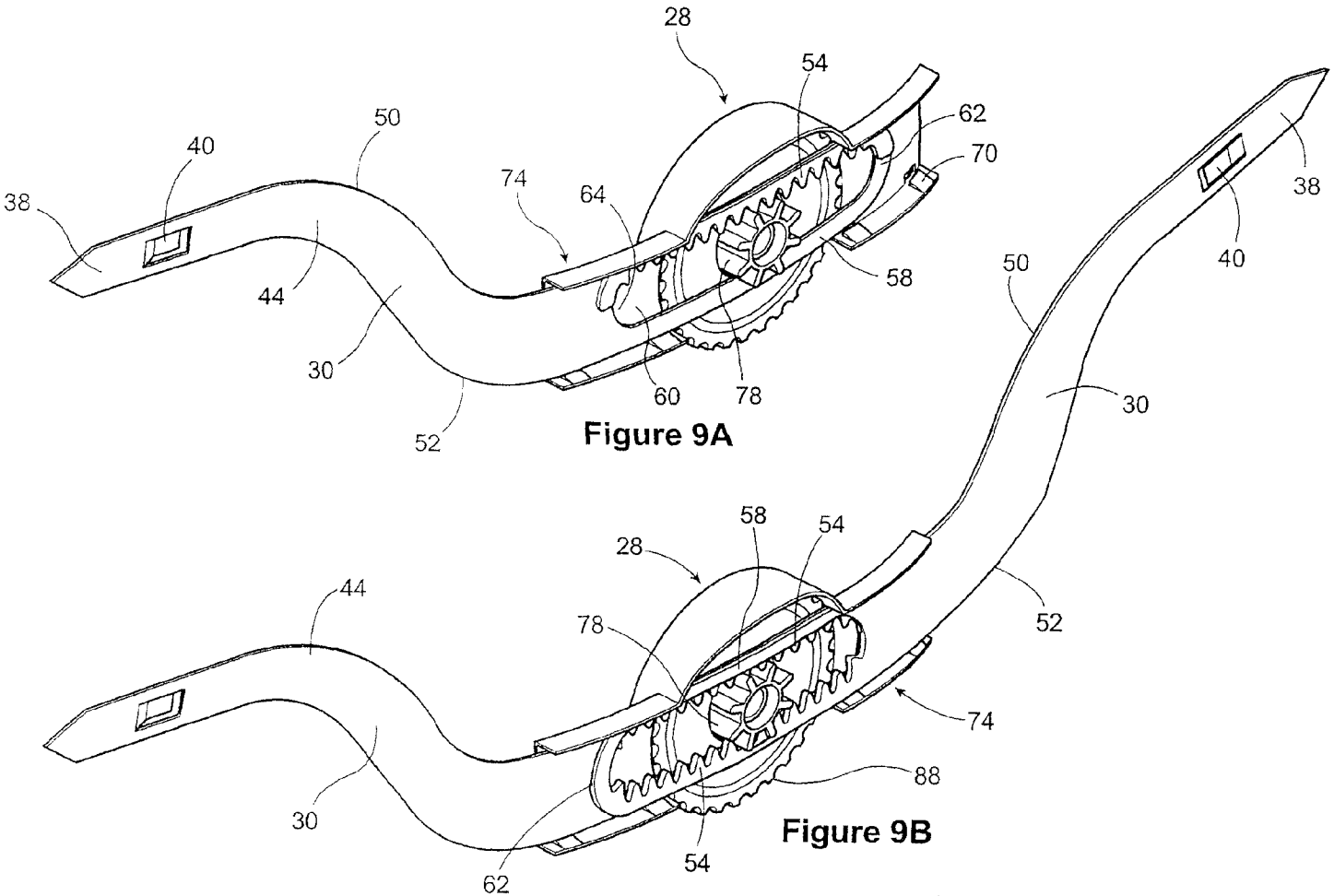
FIG. 9A illustrates the components of the adjustment mechanism of FIG. 8 having the end of the connector assembled thereto.
FIG. 9B illustrates the adjustment mechanism of FIG. 9A showing ends of two connectors assembled thereto.

As shown in FIG. 9A, teeth 54 of a connector 30 may be brought into engagement with sprocket 78. In this configuration, movement of sprocket 78 encourages movement of connector 30 generally towards and away from adjustment mechanism 28.

FIG. 9B illustrates sprocket 78 having a second connector 30 mounted thereto. Note that when sprocket 78 is rotated, both connectors 30 are moved in opposite directions so that such connectors 30 cooperate to move respective connected moveable padding portions 32 to vary the shape defined by helmet 20. Alternatively, connectors 30 may be connected to the same padding portion 32, or they may be assembled to move in similar directions when sprocket 78 is rotated. In some circumstances, the orientation of connectors 30 may be changed, and rotation of sprocket 78 will not necessarily cause movement of connectors 30 in opposite directions. In a further alternative embodiment, teeth 54 of more than one connector 30 may be mounted to the same side of sprocket 78. In such configuration, rotation of sprocket 78 will translate into each connector 30 moving along a similar axis (not shown).

As noted, connector 30, including an end 38 thereof, may be made of varying thicknesses to accommodate configurations having more than one connector 30 attached to adjustment mechanism 28. Additionally or alternatively, the dimensions of adjustment mechanism 28 may be varied to accommodate more than one connector 30. For example, the depth of adjustment mechanism 28 (taken generally along an axis of rotation of sprocket 78) may be increased to accommodate additional connectors 30.

Figures 9C, 9D:
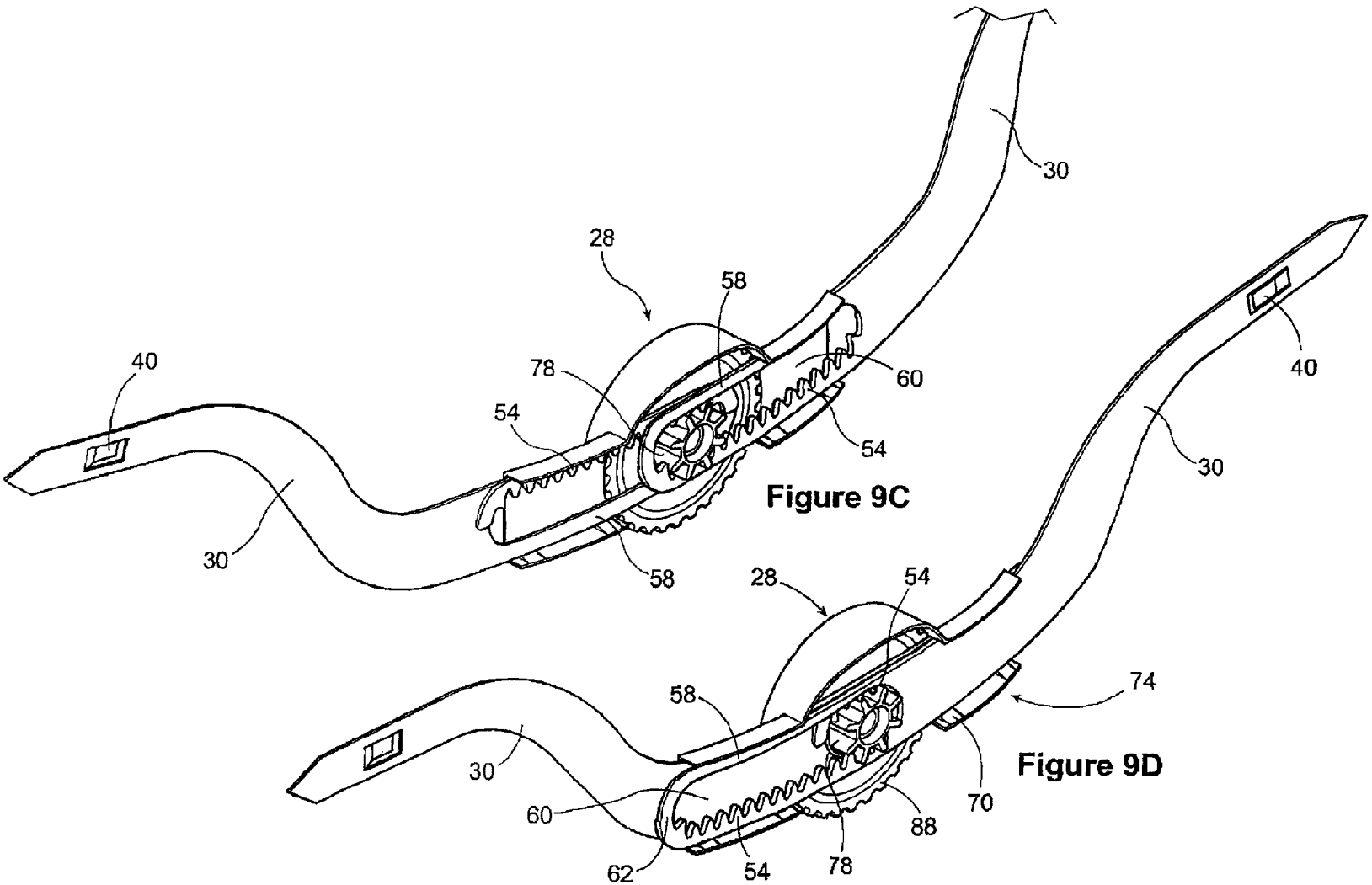
FIG. 9C illustrates the adjustment mechanism of FIG. 9B wherein the connector ends are located in generally extended positions.
FIG. 9D illustrates the adjustment mechanism of FIG. 9B wherein the connector ends are in generally retracted positions.

FIGS. 9C and 9D illustrate the adjustment mechanism 28 and mounted connectors 30 with the connectors 30 in extended positions (FIG. 9C) and in retracted positions (FIG. 9D). Sprocket 78 may also be used to locate connectors 30 in intermediate positions. As noted, movement of one or more connectors 30 results in movement of a connected padding portion(s) 32 to vary the shape of a volume defined by helmet 20.

Figure 10:
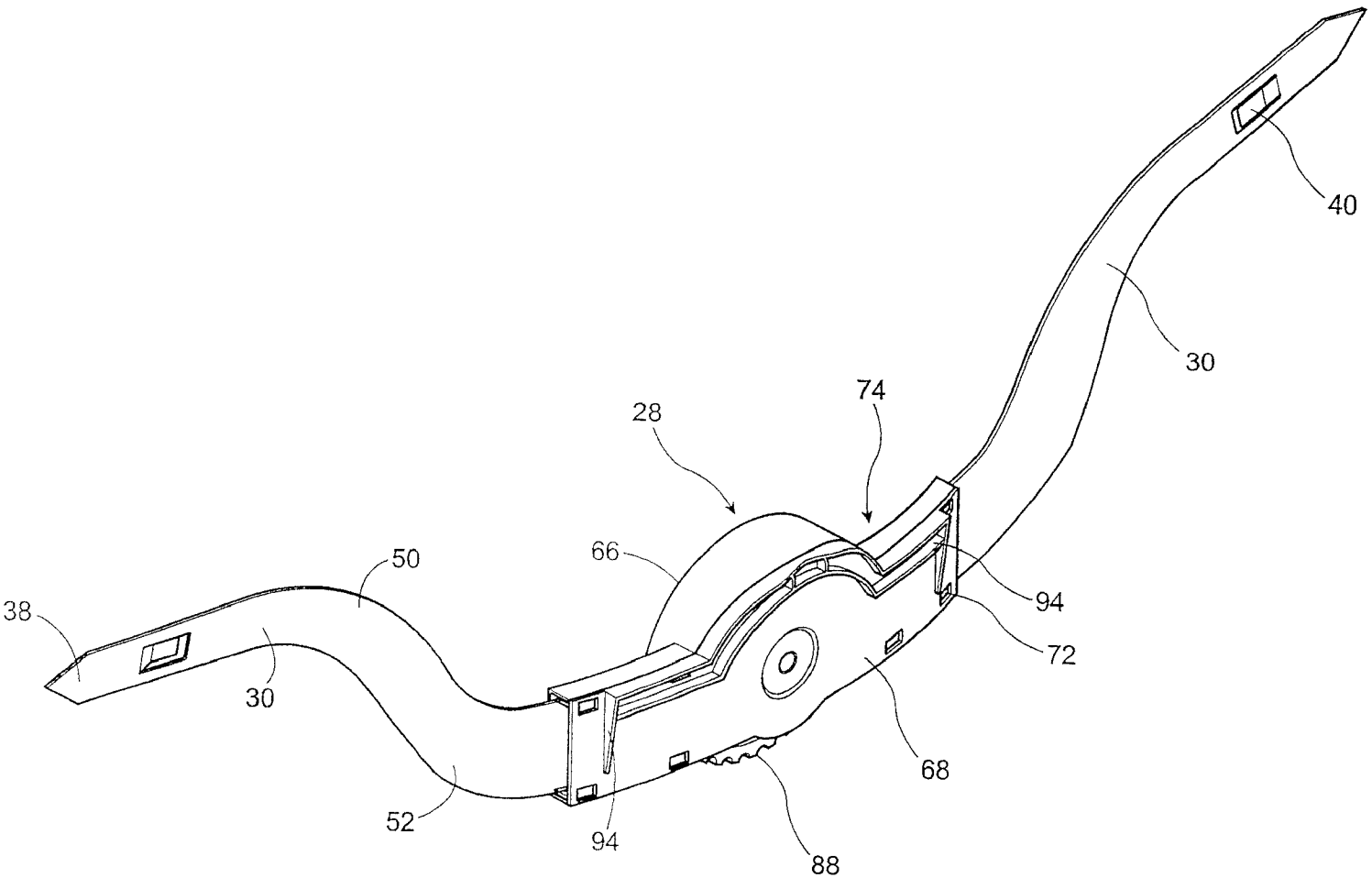
FIG. 10 illustrates the adjustment mechanism of FIG. 9B including a complementary body of the adjustment mechanism assembled thereto.

FIG. 10 shows an assembled adjustment mechanism 28 having body member 68 mounted thereto. Body member 68 may be used to provide structural integrity to adjustment mechanism 28 and to retain one or more components thereof. Body member 68 may also help to inhibit the collection of dirt, debris, or other items that may interfere with operation of adjustment mechanism 28.

Certain elements of adjustment mechanism 28 such as post 76 may be integrally formed, or mounted to, any of helmet shell 22 or padding 24. Other components of adjustment mechanism 28 may be mounted thereto. In such alternative configuration, one or both of body members 66 and 68 may be eliminated in whole or in part and replaced with portions of shell 22 and/or padding 24. Either or both of body members 66 and 68 may have strengthening members, such as one or more ribs 94. This may permit a reduction in the amount of material used to form adjustment mechanism 28.

Figure 11:
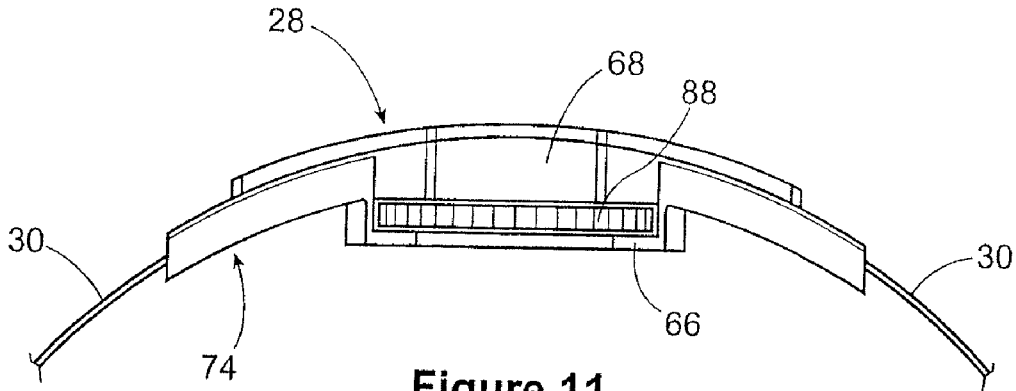
FIG. 11 illustrates a bottom view of the adjustment mechanism of FIG. 10.

FIG. 11 shows another view of adjustment mechanism 28. In this view, body members 66 and 68 provide access to wheel 88 so that it may be rotated to adjust helmet 20. A body member, such as body member 68 may further include an extension 96 which may be received by a corresponding groove 97 of wheel 88 (see also FIGS. 6 and 8). Extension 96 may assist in encouraging wheel 88 to maintain its alignment for rotating sprocket 78 which engages teeth 54 of connector 30.

Figure 12:
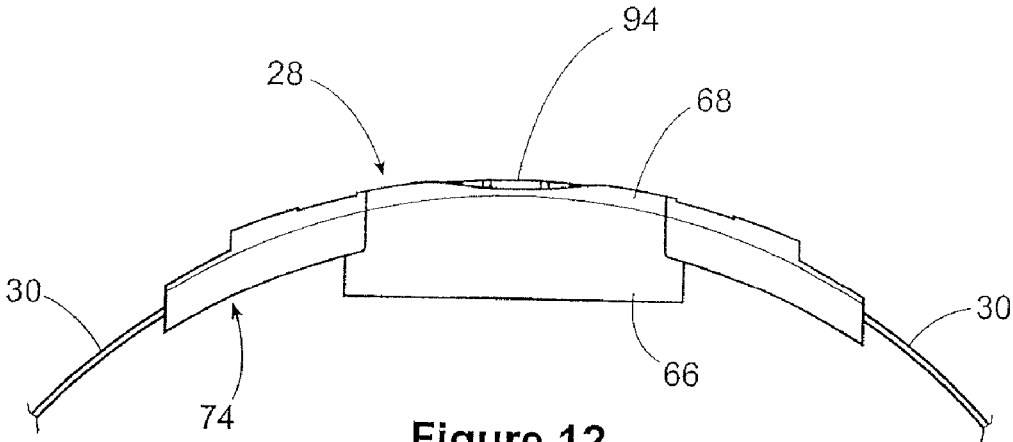
FIG. 12 illustrates a top view of the adjustment mechanism of FIG. 10.

FIG. 12 illustrates that adjustment mechanism 28 may be configured to conform to a surface of one or more of shell 22 and padding 24. Such configuration may reduce the degree of play between adjustment mechanism 28 and shell 22/padding 24.

Figure 13:
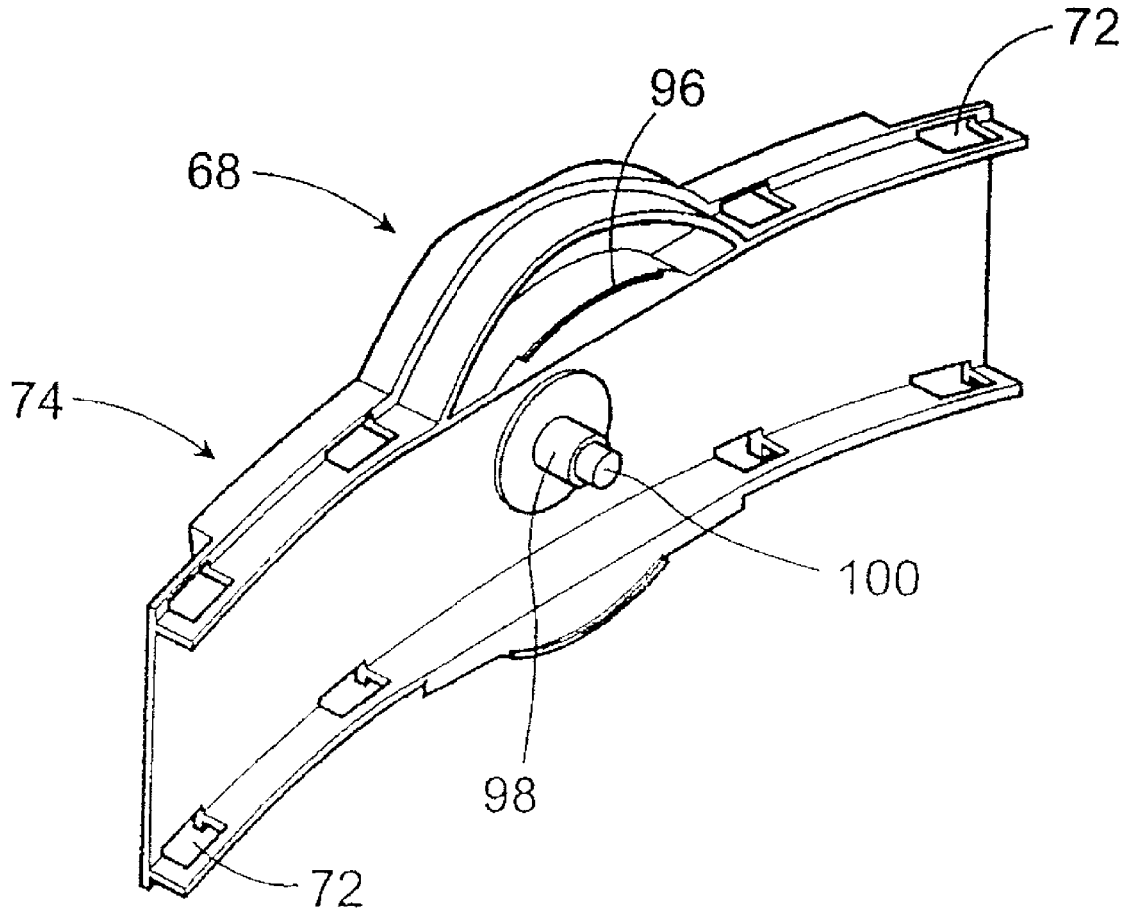
FIG. 13 illustrates the complementary body piece of FIG. 10, shown from an opposite direction of FIG. 10.

As shown in FIG. 13, body member 68 may also include a guide member in the nature of a post 98. Post 98 may slidingly engage sprocket 78 to encourage rotation thereof about an axis. Post 98 may also include a nub 100 for matingly engaging a corresponding feature 102 of body member 66. Feature 102 may be defined by post 76. The cooperation of nub 100 and feature 102 may impart rigidity to adjustment mechanism 28, and may provide a more rigid axis about which sprocket 78 may be rotated.

Figure 14A:
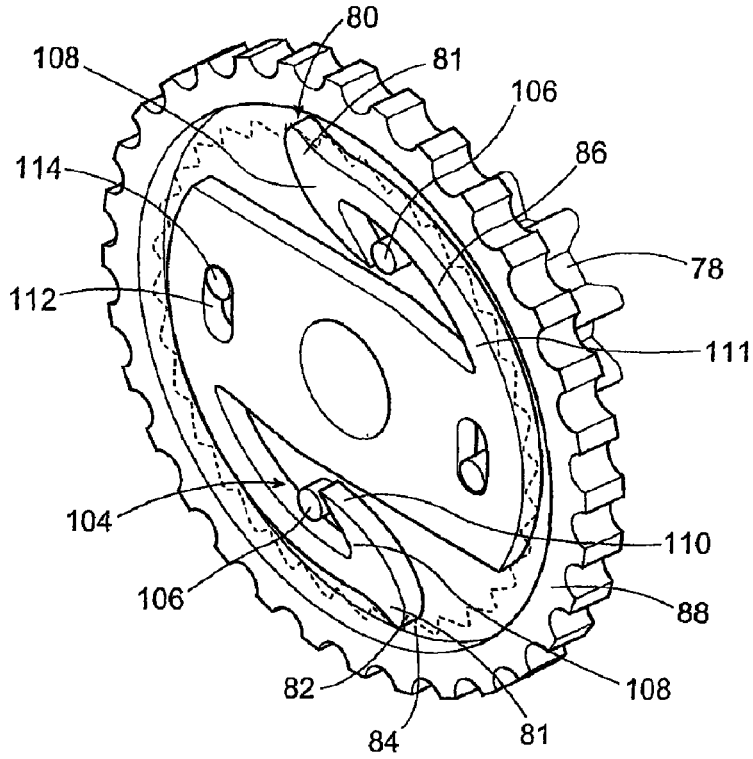
FIG. 14A illustrates an isolated view of the ratchet assembly of the adjustment mechanism of FIG. 6, with notches of the body of the adjustment mechanism shown in phantom.
Figure 14B:
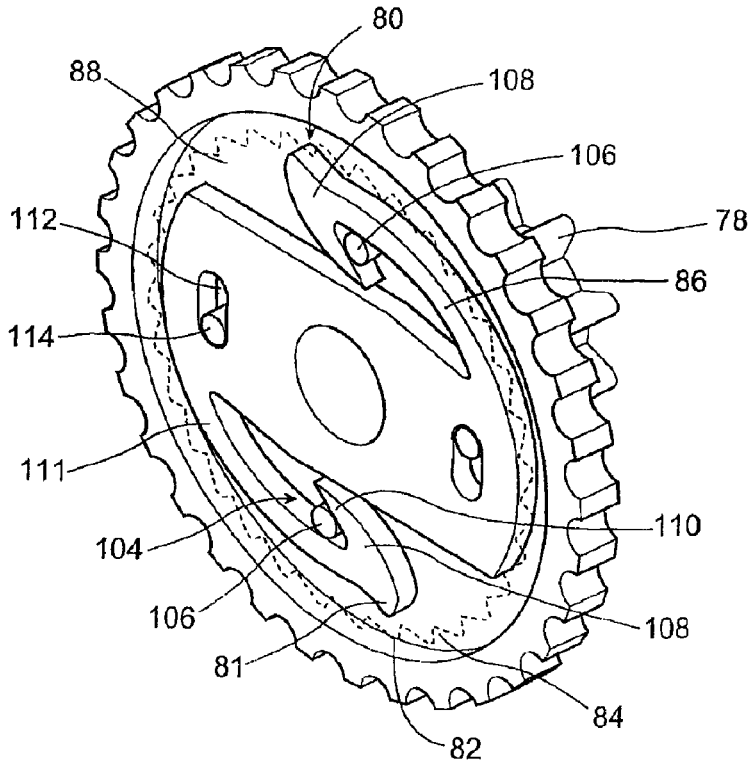
FIG. 14B illustrates the components of the adjustment mechanism illustrated in FIG. 14A with posts of the wheel rotated to release at least one ratchet element of the adjustment mechanism of FIG. 6.

In FIGS. 14A and 14B, sprocket 78, ratchet 80 and wheel 88 are shown in isolated view. Bumps 84 and notches 82 are shown in phantom for illustrative purposes. Adjustment mechanism 28 may include at least one release 104 for ratchet 80. Release 104 may be mounted to wheel 88. Release 104 may be used to draw pawl 81 away from an associated notch 82 to permit pawl 81 to clear bumps 84. When pawl 81 is permitted to clear bumps 84, sprocket 78 may turn in either direction to permit adjustment of helmet 20. For example, connector 30 may be drawn away from adjustment mechanism 28 to facilitate a loosening of helmet 20.

Release 104 cooperates with ratchet 80. In the illustrated embodiment, release 104 may be in the form of a projection 106 extending from wheel 88. Projection 106 is located to engage a feature such as a barb 108. When wheel 88 is in an initial position (as in FIG. 14B) a free end 110 of barb 108 may be aligned with projection 106. When wheel 88 is rotated in one direction, attached projection 106 rotates with it in a direction away from barb 108. As wheel 88 is rotated in this manner, sprocket 78 engages connector 30 to move it. In the illustrated embodiment, sprocket 78 rotates to pull connector 30 towards it, to draw connected padding portion 32 inwards to make the fit of helmet 20 somewhat smaller. Movement of connector 30 in an opposite direction is inhibited by ratchet 80. (Adjustment mechanism 28 may alternatively be configured so that ratchet 80 permits connector 30 to be manually pulled or pushed by adjustment mechanism 28 away from adjustment mechanism 28, for example, to create a looser fit of helmet 20; this embodiment is not shown.)

To facilitate rotation of sprocket 78 in the opposite direction to that described above, wheel 88 is rotated in such opposite direction and projection 106 engages barb free end 110 to draw pawl 81 away from a notch 82 in a generally radially inward direction. When a force is no longer applied to wheel 88, pawl 81 resiliently returns to a location in one of notches 82 to inhibit further rotation of sprocket 78. Other arrangements may be used to move pawl 81 from notch 82. For example, pawl 81 may be pulled by a switch or lever, or in some other manner. A projection 106 may be provided for each pawl 81 of adjustment mechanism 28, as shown in FIG. 14A.

Projection 106, when rotated away from barb 108, may be brought into abutting relationship with a part of sprocket 78, including arm 86. For example, projection 106 may abut a proximal end 111 of arm 86. When projection 106 abuts one or more of these elements, it may be used to encourage rotation of sprocket 78. Depending upon the configuration of adjustment mechanism 28, this may require that wheel 88 be rotated through an arc before there is any corresponding movement in sprocket 78. To reduce the degree of such rotation required, sprocket 78 (or one of the elements attached thereto) may be provided with a slot 112. Slot 112 is configured to permit movement of another projection 114 of wheel 88. As wheel 88 is rotated so that project 106 is encouraged to move in a direction away from barb 108, projection 114 is likewise moved within slot 112. When projection 106 clears barb 108, projection 114 abuts a side of slot 112 to encourage movement of sprocket 78. When wheel 88 is moved in an opposite direction, projection 106 is permitted to engage barb 108 to draw pawl 81 out of notch 82. In the illustrated embodiment, projections 106 and 114 are located on a common arc about sprocket 78. However, they may each be located differentially radially inwardly or outwardly of sprocket 78 to achieve a similar result. Similarly, one or more of each of projections 106 and 114 may be employed to operate as described herein. Just one projection 106 may alternatively be employed, without the use of additional projections 106 or 114.

In an alternative embodiment, sprocket 78 may be oriented to rotate about an axis generally normal to the axis of rotation shown in the figures. In such configuration, sprocket 78 may still engage teeth 54 of connector, but body members 66 and 68 may need to be a different shape to accommodate the variation in the geometry of the components of adjustment mechanism 28 and connector(s) 30. In this embodiment, teeth 54 of connector 30 may be configured as a series of slots for engaging sprocket 78.

FIGS. 15A, 155B, 16A and 166B illustrate that the adjustment mechanism 28 described herein may be used with a wide variety of helmets. For example, adjustment mechanism 28 may be used in conjunction with other adjustment mechanisms, such as an adjustment mechanism that permits adjustment of shell 22.

Figure 15A:
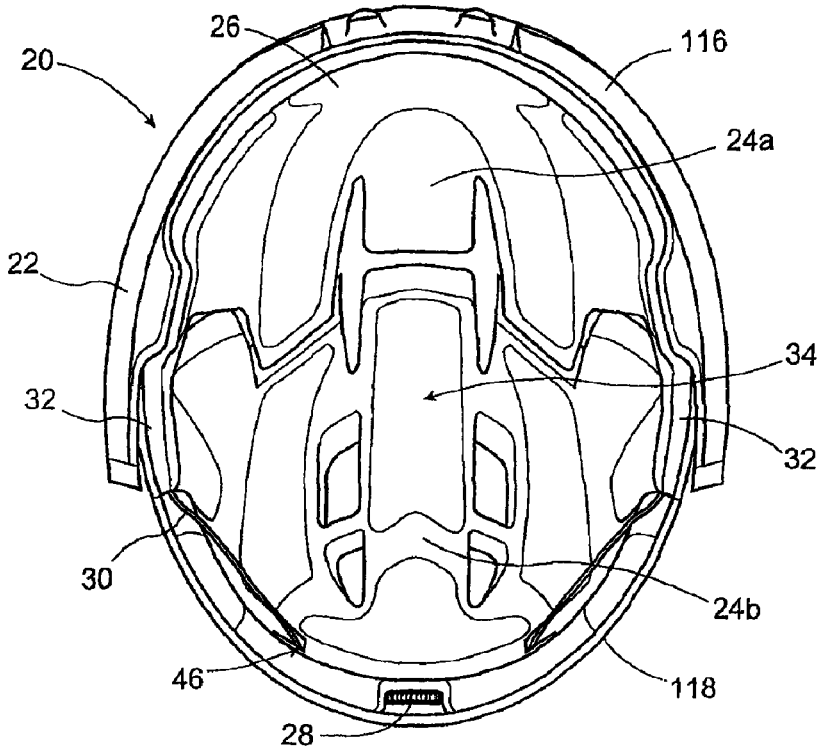
FIG. 15A illustrates a bottom view of the helmet of FIG. 1.
Figure 15B:
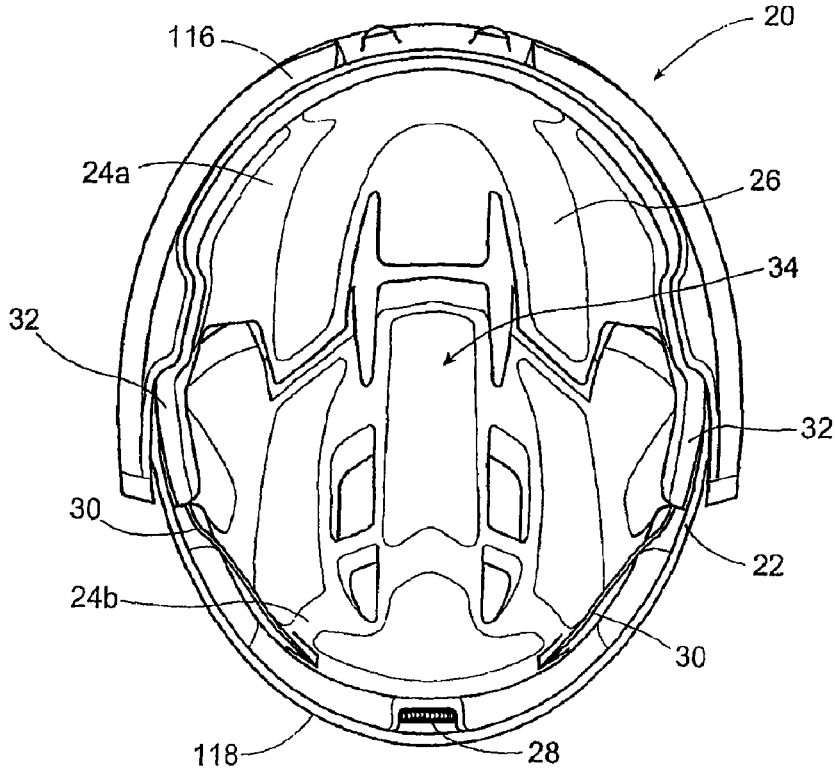
FIG. 15B illustrates the helmet of FIG. 15A having at least one connector in a retracted position.

In FIGS. 15A and 15B, helmet shell portions 116 and 118 are shown adjacent one another to reduce the size of helmet 20 longitudinally. As shown in FIG. 15B, adjustment mechanism 28 may be used to pull connectors 30 to cause padding portions 32 to move to modify the shape of the volume defined by helmet 20.

Figure 16A:
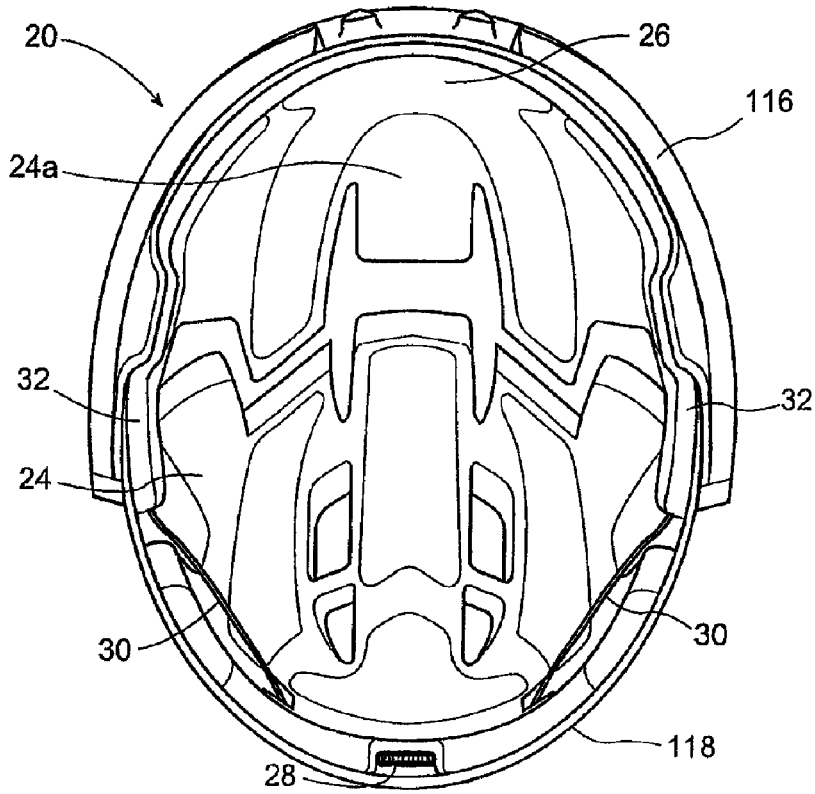
FIG. 16A illustrates the helmet of FIG. 15A with helmet portions in an extended position.
Figure 16B:
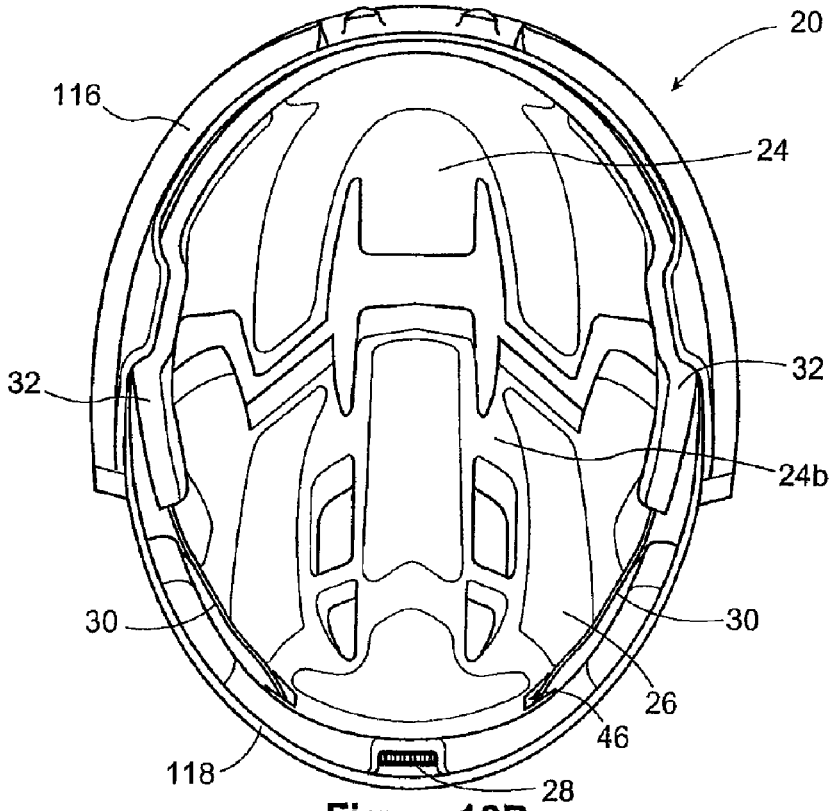
FIG. 16B illustrates the helmet of FIG. 16A with the connectors in a retracted position.

Similarly, in FIGS. 16A and 16B, helmet portions 116 and 118 are distanced from one another longitudinally. FIG. 16B illustrates that adjustment mechanism 28 may be used to pull connectors 30 to vary the position of padding portions 32. Similarly, in FIGS. 15A and 16A, connectors 30 may be pushed or released by adjustment mechanism 28 to permit padding portions 32 to become located adjacent shell 22. When helmet 20 has shell portions 116 and 118 in an extended position, it may be possible for adjustment mechanism 28 to encourage movement of padding portions 32 and any adjacent or attached padding to move as well due to the extra space between shell portions 116 and 118.

Adjustment mechanism 28 may also be used to move shell portions 116 and 118 if one or more connectors 30 are mounted to one of portions 116 and 118, and adjustment mechanism 28 is mounted to the other of portions 116 and 118. Padding 24 may optionally be included. If included, padding 24 may be encouraged to move with attached portions 116 and 118.

In the embodiments shown in FIGS. 15A to 16B, padding portions 32 are located on somewhat opposite sides of an interior of helmet 20. As adjustment mechanism 28 moves connectors 30, padding portions 32 may be moved towards and away from each other to accommodate different head sizes and comfort or safety needs. For example, rotating wheel 88 counter-clockwise (when viewed from the outside of helmet 20 looking in) causes sprocket 78 to pull both connectors 30, which causes attached padding portions 32 to be pulled laterally inward of shell 22 adjacent the temples of a wearer. Such inward movement may grip or clamp a wearer's head when helmet 22 is worn. This arrangement may be modified to include two or more padding portions 32 in different locations to grip, clamp, or to provide a point of contact for a wearer's head.

In an alternative embodiment, two or more connectors 30 may be asymmetrically mounted to sprocket 78. As sprocket 78 is adjusted the respective padding portions 32 attached to connectors 30 may be moved to different relative distances from shell 22. Similarly, two or more connectors 30 may be attached to respective padding portions 32 wherein each padding portion 32 is differentially displaced from shell 22. Rotation of sprocket 78 encourages padding portions 32 to move but the padding portions are still differentially displaced from shell 22, but to different degrees of displacement.

In use, helmet 20 may be adjusted by a wearer while worn or when removed. It may be adjusted manually, without the use of tools, for example, when it is held. A third party may also adjust the helmet while it is on a wearer. Wheel 88 is rotated to encourage movement of padding portions 32 relative to shell 22 to achieve a desired fit. This procedure may be carried out by using one or more thumbs and/or fingers. This process may take a matter of seconds, and may even be carried out, for example, during game play, as needed. Helmet 20 may also be adjusted while wearing gloves, depending to some extent on the bulk and flexibility of the gloves used. A notch 120 may be formed in helmet shell 22 to provide access to an edge of wheel 88 (see FIGS. 2 and 3). As may be understood, the movement of wheel 88 may be in one direction to tighten the fit and in the other to loosen the fit.

In the forgoing description of the various embodiments of helmet 20, if the helmet includes more than one of a given feature, then only one such feature will generally be described. For example, helmet 20 as shown in FIG. 1 may have more than one adjustment mechanism 28 located adjacent a side of helmet 20. However, the description may focus primarily on just one adjustment mechanism 28. In some instances, other like components may not be identical to those described. For example, two connectors 30 may be similarly configured as primarily mirror images of one another. Nevertheless, it will be understood that the description of one applies to the other(s) without substantial modification.

The foregoing description of various embodiments of the invention is made in the context of a hockey helmet. Nevertheless, the various embodiments may be applied to other types of helmets, as appropriate, including helmets used in other sports (e.g., football, lacrosse, skiing, skateboarding, rollerblading), for hazardous work environments or, perhaps less commonly, for fashion.

While the foregoing embodiments of the invention have been described in some detail for purposes of clarity and understanding, it will be appreciated by one skilled in the art, that numerous modifications, variations, and adaptations may be made to the particular embodiments of the invention described above without departing from the scope of the invention, which is defined in the following claims.

What is claimed is:

1. A helmet comprising:

an external protective shell;

protective material mounted internally on said shell and including a fixed portion substantially covering an internal surface of said helmet and being connected thereto, and first and second movable portions connected to one of said shell and said fixed portion about respectively a first and second temple area of the helmet, the movable portions being movable relative to said shell and to the fixed portion of protective material;

at least one adjustment mechanism mounted adjacent said shell; and connectors operationally connected to said movable portions of protective material and to said at least one adjustment mechanism, said connectors being displaceable by said at least one adjustment mechanism such that said connectors moves said movable portions of protective material while said fixed portion of protective material remains in a fixed position relative to said shell, so as to vary a volume defined by said helmet.

2. The helmet of claim 1 wherein said movable portions of protective material are connected to the fixed portion.

3. The helmet of claim 1 wherein said movable portions of protective material are movable generally inwardly of said shell.

4. The helmet of claim 1 wherein said movable portions of protective material are movable generally along an inner surface of said shell.

5. The helmet of claim 1 wherein said movable portions of protective material are generally symmetrically located adjacent the internal surface.

6. The helmet of claim 1 wherein said at least one adjustment mechanism is located at a longitudinal end of said shell, said movable portions of protective material being displaceable closer to each other when said at least one adjustment mechanism displaces said connectors.

7. The helmet of claim 1 wherein said connectors include first and second connectors and said at least one adjustment mechanism includes first and second adjustment mechanisms, said first connector being operationally connected to the first movable portion and to the first adjustment mechanism, and said second connector being operationally connected to the second movable portions and to the second adjustment mechanism.

8. The helmet of claim 1 wherein said at least one adjustment mechanism is mounted to said shell by being sandwiched between said shell and said protective material.

9. The helmet of claim 1 wherein said at least one adjustment mechanism is mounted to a surface of said shell.

10. The helmet of claim 1 wherein said protective material is selected from a group comprising a shock absorbing liner, a compressible liner, a foam and a styrofoam-type material.

11. The helmet of claim 1 wherein said movable portions of protective material are hinged to said shell.

12. The helmet of claim 1 wherein said movable portions of protective material are movably pinned to said shell.

13. The helmet of claim 2 wherein the protective material further comprises a deformable area to permit movement of said movable portion of protective material.

14. The helmet of claim 1 wherein at least a portion of at least one of said connectors is located adjacent an exterior surface of said helmet.

15. The helmet of claim 1 wherein at least a portion of at least one of said connectors is located adjacent an interior surface of said helmet.

16. The helmet of claim 1 wherein said movable portions of protective material each define an opening for receiving an end of one of said connectors, said one of said connectors further comprising a retainer for inhibiting removal of said end from said opening.

17. The helmet of claim 16 wherein said connectors are bands made of plastic, and said retainer is a resilient prong of said connector end, the prong being deformable to permit said end to be inserted into said opening and to engage a wall of said opening to discourage removal of said end from said opening.

18. The helmet of claim 1 wherein each of said connectors is a band made of plastic that is bendable to conform to an interior of said helmet, yet that is rigid enough to transfer force from said at least one adjustment mechanism to move one of said movable portions of said protective material.

19. The helmet of claim 1 wherein said connectors include at least one material selected from the group consisting of a cable, rope, belt, chain, cord, string, rubber, and a resilient deformable material.

20. The helmet of claim 1 wherein each of said at least one adjustment mechanism includes a sprocket rotatably mounted thereto, each of said connectors includes at least two teeth for engaging said sprocket to be displaced when said sprocket is rotated.

21. The helmet of claim 20 wherein said teeth are aligned along a length of an opening defined by said connector, said opening being dimensioned to permit placement and rotation of said sprocket therein, and wherein said sprocket moves relative to said connector within said opening when said sprocket is rotated.

22. The helmet of claim 20 wherein said at least one adjustment mechanism includes a ratchet to facilitate rotation of said sprocket in one direction and to inhibit rotation of said sprocket in the other direction.

23. The helmet of claim 22 wherein said ratchet includes a pawl and at least two corresponding notches defined along a generally circular feature which is axially aligned with said sprocket, and wherein said notches include an inclined face for permitting movement of said pawl out of said notch when said sprocket is rotated in said one direction.

24. The helmet of claim 23 wherein said pawl projects from said sprocket and is resiliently biased into said notches.

25. The helmet of claim 22 wherein said ratchet includes a release to permit rotation of said sprocket in both directions.

26. The helmet of claim 24 wherein said adjustment mechanism includes a wheel mounted to said sprocket for rotating said sprocket, said wheel having at least one projection for engaging said resilient pawl to draw said pawl away from at least one of said notches when a rotational force is applied to said wheel in said other direction, said pawl resiliently returning to one of said notches when a rotational force is not applied to said wheel.

27. The helmet of claim 26 wherein said pawl is arcuate and includes a barb at a distal end thereof for engaging said wheel projection when said wheel is rotated in said other direction, and said sprocket permits rotation of said wheel relative to said sprocket sufficient for said projection to engage said barb to move said pawl from one of said notches.

28. The helmet of claim 20, wherein said at least one adjustment mechanism further comprises a guide for receiving said connectors to encourage generally linear movement of said connectors when said sprocket is rotated.

29. The helmet of claim 20 wherein said teeth of an end of a first one of said connectors are linearly spaced and are oriented to tangentially engage said sprocket along one side of said sprocket, and said teeth of an end of a second one of said connectors are oriented to tangentially engage said sprocket along another side of said sprocket at an angle relative to the teeth of said first connector.

30. A helmet comprising:

a shell including first and second discrete shell sections in overlapping engagement with one another, said sections being slidable relative to one another along a longitudinal direction of the helmet;

an adjustment mechanism mounted to said first shell section;

a connector mounted between said second shell section and said adjustment mechanism; and wherein the entire connector moves in the general direction of said adjustment mechanism when pulled by said adjustment mechanism, to encourage said second shell section to slide and vary the shape of the volume defined by said helmet.

31. A helmet comprising:

a shell including a first shell section and a second shell section, said sections being slidable relative to one another along a longitudinal direction of the helmet;

an adjustment mechanism mounted to said first shell section;

a connector mounted between said second shell section and said adjustment mechanism;

wherein the entire connector moves in the general direction of said adjustment mechanism when pulled by said adjustment mechanism, to encourage said second shell section to slide and vary the shape of the volume defined by said helmet; and wherein said adjustment mechanism includes a sprocket rotatably mounted thereto, said connector includes at least two teeth for engaging said sprocket, and wherein said connector is displaced when said sprocket is rotated.

32. The helmet of claim 31 wherein said connector is a band made of a resilient deformable material.

33. The helmet of claim 31 wherein said teeth are aligned along a length of an opening defined by said connector, said opening being dimensioned to permit placement and rotation of said sprocket therein, and wherein said sprocket moves relative to said connector within said opening when said sprocket is rotated.

34. The helmet of claim 31 wherein said adjustment mechanism includes a ratchet to facilitate rotation of said sprocket in one direction and to inhibit rotation of said sprocket in the other direction.

35. The helmet of claim 34 wherein said ratchet includes a pawl and at least two corresponding notches defined along a generally circular feature which is axially aligned with said sprocket, and wherein said notches include an inclined face for permitting movement of said pawl out of said notch when said sprocket is rotated in said one direction.

36. The helmet of claim 35 wherein said pawl projects from said sprocket and is resiliently biased into said notches.

37. The helmet of claim 34 wherein said ratchet includes a release to permit rotation of said sprocket in both directions.

38. The helmet of claim 36 wherein said adjustment mechanism includes a wheel mounted to said sprocket for rotating said sprocket, said wheel having at least one projection for engaging said resilient pawl to draw said pawl away from at least one of said notches when a rotational force is applied to said wheel in said other direction, said pawl resiliently returning to one of said notches when a rotational force is not applied to said wheel.

39. The helmet of claim 38 wherein said pawl is arcuate and includes a barb at a distal end thereof for engaging said wheel projection when said wheel is rotated in said other direction, and said sprocket permits rotation of said wheel relative to said sprocket sufficient for said projection to engage said barb to move said pawl from one of said notches.

40. The helmet of claim 31, said adjustment mechanism further comprising a guide for receiving an end of said connector to encourage generally linear movement of said connector end when said sprocket is rotated.

41. The helmet of claim 31, said helmet further comprising a second connector having an end for cooperating with said sprocket.

42. The helmet of claim 41 wherein said teeth of said first connector end are linearly spaced and are oriented to tangentially engage said sprocket along one side of said sprocket, and teeth of said second connector end are oriented to tangentially engage said sprocket along another side of said sprocket at an angle relative to the teeth of said first connector end.

43. A helmet comprising:

an external protective shell including a first shell section and a second shell section, said second shell section being movable relative to said first shell section;

protective material mounted internally to said first shell section with at least a portion of said material being movable relative to said first shell section;

an internal adjustment mechanism mounted adjacent and inside of said second shell section; and a connector directly connected to said movable portion of protective material and to said adjustment mechanism, said connector being displaceable by said adjustment mechanism such that said connector moves said movable portion of protective material so as to vary the volume defined by said helmet.

44. A helmet comprising:

an external protective shell;

protective material mounted internally on said shell with at least a portion of said material being movable relative to said shell;

an adjustment mechanism mounted adjacent said shell; and a connector directly connected to said movable portion of protective material and to said adjustment mechanism, said connector being displaceable by said adjustment mechanism such that said connector moves said movable portion of protective material no as to vary the volume defined by said helmet;

and wherein said adjustment mechanism includes a sprocket rotatably mounted thereto, said connector includes at least two teeth for engaging said sprocket, and wherein said connector is displaced when said sprocket is rotated, said adjustment mechanism including a ratchet to facilitate rotation of said sprocket in one direction and to inhibit rotation of said sprocket in the other direction, said ratchet including a pawl and at least two corresponding notches defined along a generally circular feature which is axially aligned with said sprocket, and wherein said notches include an inclined face for permitting movement of said pawl out of said notch when said sprocket is rotated in said one direction.

45. The helmet of claim 44 wherein said pawl projects from said sprocket and is resiliently biased into said notches.

46. The helmet of claim 44 wherein said ratchet includes a release to permit rotation of said sprocket in both directions.

47. The helmet of claim 44 wherein said adjustment mechanism includes a wheel mounted to said sprocket for rotating said sprocket, said wheel having at least one projection for engaging said resilient pawl to draw said pawl away from at least one of said notches when said a rotational force is applied to said wheel in said other direction, said pawl resiliently returning to one of said notches when a rotational force is not applied to said wheel.

48. The helmet of claim 44 wherein said pawl is arcuate and includes a barb at a distal end thereof for engaging said wheel projection when said wheel is rotated in said other direction, and said sprocket permits rotation of said wheel relative to said sprocket sufficient for said projection to engage said barb to move said pawl from one of said notches.

* * * * *